US008578915B2

(12) United States Patent
Sopinsky et al.

(10) Patent No.: US 8,578,915 B2
(45) Date of Patent: Nov. 12, 2013

(54) TOY

(75) Inventors: Brandon Sopinsky, El Segundo, CA (US); Michael L. Strauss, Signal Hill, CA (US)

(73) Assignee: Mattel, Inc., El Segundo, CA (US)

( * ) Notice: Subject to any disclaimer, the term of this patent is extended or adjusted under 35 U.S.C. 154(b) by 267 days.

(21) Appl. No.: 13/093,398

(22) Filed: Apr. 25, 2011

(65) Prior Publication Data

US 2011/0259310 A1 Oct. 27, 2011

Related U.S. Application Data

(60) Provisional application No. 61/327,338, filed on Apr. 23, 2010.

(51) Int. Cl.
*F41B 7/08* (2006.01)

(52) U.S. Cl.
USPC ..... 124/16; 124/26; 124/31

(58) Field of Classification Search
USPC ..... 124/16, 26, 27, 31; 446/435
See application file for complete search history.

(56) References Cited

U.S. PATENT DOCUMENTS

| | | | | | |
|---|---|---|---|---|---|
| 3,148,478 | A | * | 9/1964 | Miller | 446/435 |
| 3,233,357 | A | * | 2/1966 | Lent | 446/397 |
| 3,392,484 | A | * | 7/1968 | Ryan et al. | 446/409 |
| 4,659,320 | A | * | 4/1987 | Rich et al. | 446/435 |
| 5,842,907 | A | * | 12/1998 | Niimura et al. | 446/435 |

* cited by examiner

*Primary Examiner* — John Ricci
(74) *Attorney, Agent, or Firm* — Cantor Colburn LLP

(57) ABSTRACT

A toy having a housing and a projectile launcher capable of moving between a first stowed position within the housing and a second deployed position extending from the housing. The toy further including a trigger mechanism for launching at least one projectile from the projectile launcher; and a selector mechanism for movement between a first position and a second position, wherein the trigger mechanism will launch only a single projectile from the projectile launcher when the selector mechanism is in the first position and the trigger mechanism is actuated and wherein the trigger mechanism will launch at least two projectiles from the projectile launcher when the selector mechanism is in the second position and the trigger mechanism is actuated.

19 Claims, 4 Drawing Sheets

TOY

CROSS REFERENCE TO RELATED APPLICATION

This application claims the benefit of U.S. Provisional Patent Application No. 61/327,338 filed Apr. 23, 2010, the contents of which are incorporated herein by reference thereto.

BACKGROUND

Various embodiments disclosed herein are related to a toy, and more particularly to a toy for launching objects.

Toys for launching objects are popular with children, however, many such toys are similar in that an object is loaded into the toy, and whether by actuating a trigger or some other device, the object is released or otherwise projected from the toy.

Accordingly, it is desirable to provide a toy for launching objects that also provides additional entertainment and stimulation to the user.

SUMMARY OF THE INVENTION

In one embodiment, a toy having a housing and a projectile launcher capable of moving between a first stowed position within the housing and a second deployed position extending from the housing. The toy further including a trigger mechanism for launching at least one projectile from the projectile launcher; and a selector mechanism for movement between a first position and a second position, wherein the trigger mechanism will launch only a single projectile from the projectile launcher when the selector mechanism is in the first position and the trigger mechanism is actuated and wherein the trigger mechanism will launch at least two projectiles from the projectile launcher when the selector mechanism is in the second position and the trigger mechanism is actuated.

In another embodiment, a hand held toy for launching projectiles is provided. The hand held toy having: a housing having a forward end and a rearward end; a projectile launcher capable of moving between a first stowed position within the housing and a second deployed position extending from the housing; a trigger mechanism for launching at least one projectile from the projectile launcher; a selector mechanism configured for movement between a first position and a second position, wherein the trigger mechanism will launch only a single projectile from the projectile launcher when the selector mechanism is in the first position and the trigger mechanism is actuated and wherein the trigger mechanism will launch at least two projectiles from the projectile launcher when the selector mechanism is in the second position and the trigger mechanism is actuated; an actuation button for moving the projectile launcher from the first stowed position to the second deployed position; and a reward handle slidably mounted to the rearward end of the housing for movement between an extracted position and an un-extracted position, wherein movement of the reward handle from the un-extracted position to the extracted position when the projectile launcher is in the second deployed position will cause the projectile launcher to be moved into the first stowed position.

In another embodiment, a method of selecting launching configurations of a toy projectile launcher is provided, the method including the steps of: sliding a selector mechanism of the toy projectile launcher between a first position and a second position, wherein the selector mechanism couples at least two members of a trigger mechanism together when the selector mechanism is in the second position such that movement of the one of the members will cause movement of the other one of the members and actuation of a button of the trigger mechanism will move one of the at least two members; and wherein the selector mechanism isolates the at least two members from each other when the selector mechanism is in the first position such that movement of the button of the trigger mechanism will only move one of the at least two members.

Additional features and advantages are realized through the techniques of the present invention. Other embodiments and aspects of the invention are described in detail herein and are considered a part of the claimed invention. For a better understanding of the invention with advantages and features, refer to the description and to the drawings.

BRIEF DESCRIPTION OF THE DRAWINGS

The invention, in accordance with preferred and various embodiments, together with further objects and advantages thereof, is more particularly described in the following detailed description taken in conjunction with the accompanying drawings in which.

Figure 1:
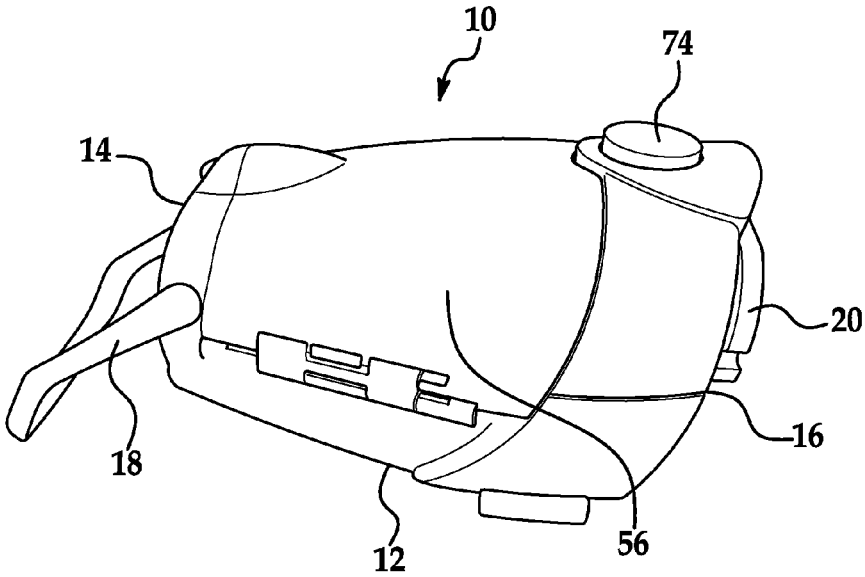
FIG. 1 is a perspective view of a toy in accordance with an exemplary embodiment of the present invention.

The detailed description explains various embodiments of the present invention, together with advantages and features, by way of example with reference to the drawings.

DETAILED DESCRIPTION OF THE INVENTION

Referring now to the attached FIGS., a toy 10 constructed in accordance with one non-limiting embodiment is illustrated. As will be discussed herein, the toy has various embodiments, configuration or combinations wherein various embodiments according to the present invention can be implemented.

As shown in the attached FIGS., toy 10 includes a main housing 12 having a first end portion 14 and a second end portion 16. Associated with the first end portion is a forward handle or grip 18 and associated with the second end portion is reward handle or grip 20. In one non-limiting embodiment, handle 20 is pivotally secured to the toy. Forward handle or grip 18 allows a user to grip the toy with one hand and pull on the rearward handle or grip with an opposite hand, which as will be discussed below allows a user to stow a projectile launcher in the main housing 12. Still further, main housing 12 has a strap 11 configured to releasably secure the main housing the arm or wrist of a user that is gripping forward handle or grip 18. In addition, the lower portion of the housing may be contoured or configured to facilitate securement of the housing to a user's arm.

Figure 2:
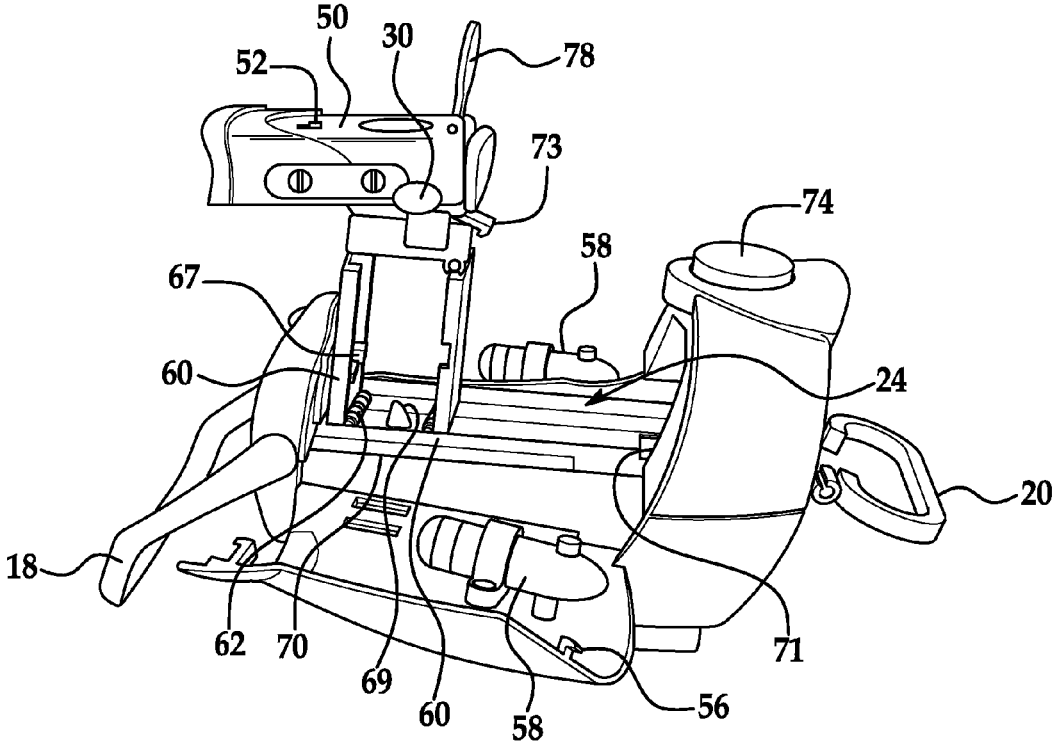
FIG. 2 is a perspective view of the toy of FIG. 1 wherein a projectile launcher is in a deployed position.
Figure 3:
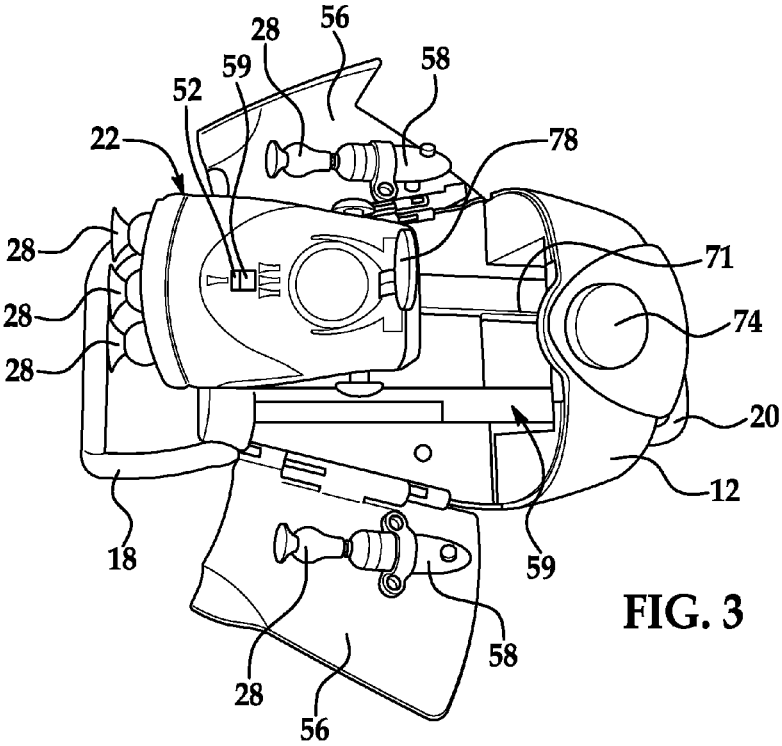
FIG. 3 is a top perspective view of the toy illustrated in FIG. 2.
Figure 4:
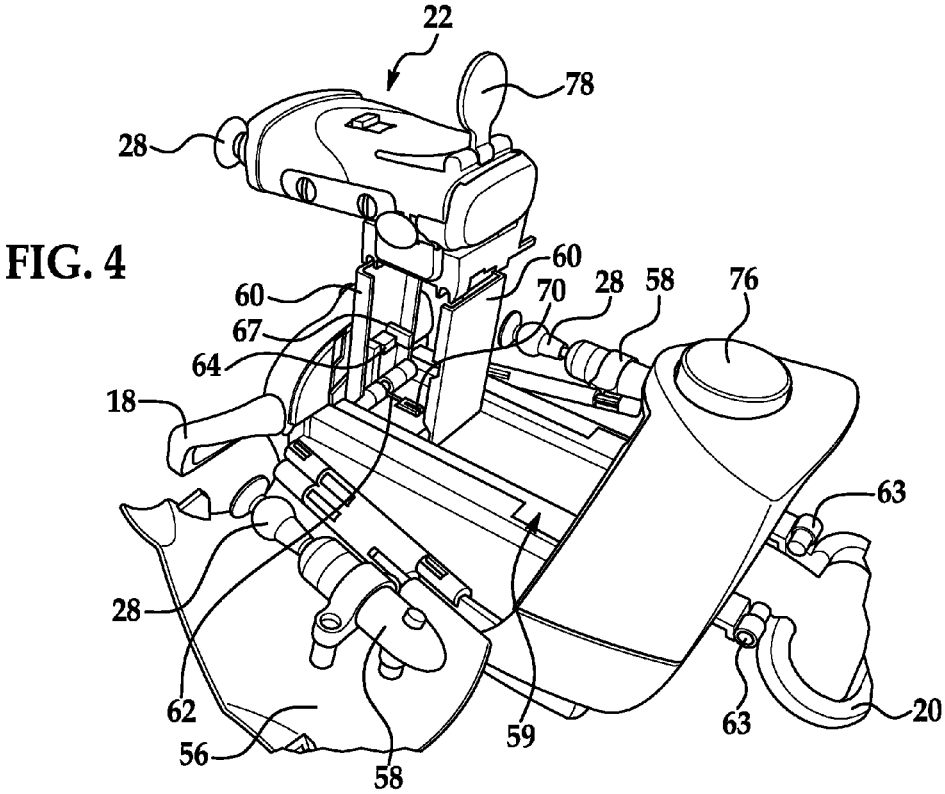
FIG. 4 is another perspective view of the toy illustrated in FIG. 2.

Received within the housing is a projectile launcher 22. The projectile launcher is movably secured to the housing for movement between a first stowed position (FIGS. 1 and 5B) and a second deployed position (FIGS. 2, 3 and 4) wherein the projectile launcher is positioned above a receiving area 24 of the housing.

Figure 7:
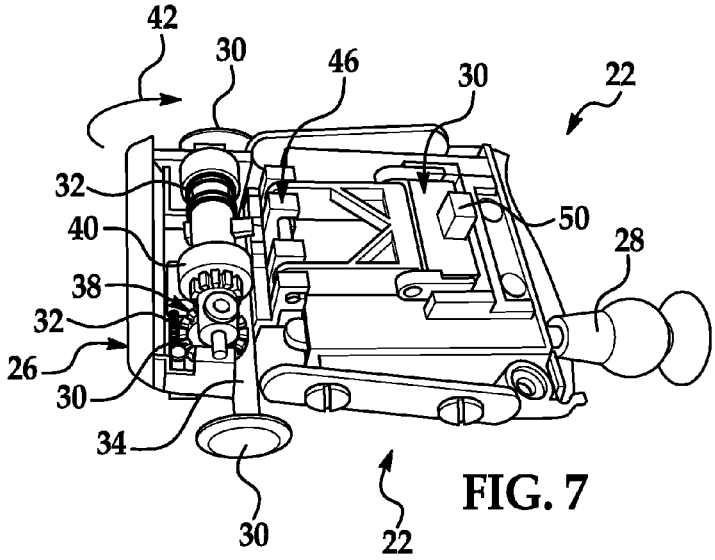
FIG. 7 is a top perspective view of the projectile launcher of FIG. 6 with a cover portion removed wherein a selector mechanism is in a first position.
Figure 8:
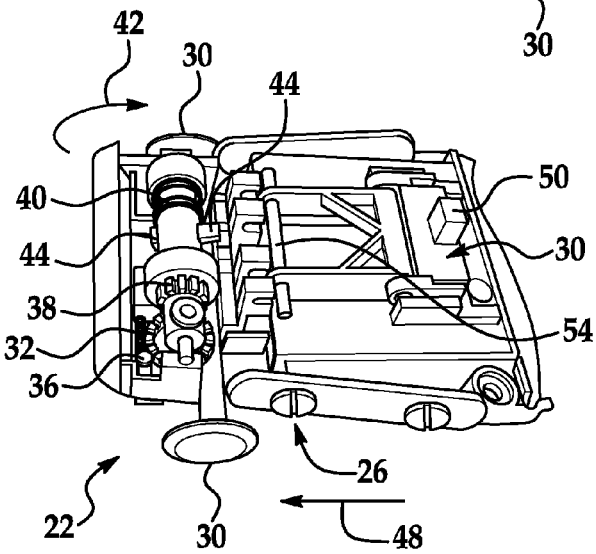
FIG. 8 is a top perspective view of the projectile launcher of FIG. 6 with the cover portion removed wherein the selector mechanism is in a second position.

Referring now to FIGS. 7 and 8, the projectile launcher includes a trigger mechanism 26 for launching at least one projectile 28 from the projectile launcher. In one non-limiting embodiment, the projectile is a dart with a suction cup at a forward end. The projectile launcher also comprises a selector mechanism 30 for movement between a first position (FIG. 8) and a second position (FIG. 7). In an exemplary embodiment, the projectile launcher will launch only one projectile when the selector mechanism is in the first position and the trigger mechanism is actuated. In one non-limiting embodiment the center projectile will be the only one launched when the trigger mechanism is actuated and the selector mechanism is in the first position. Of course, other projectiles may be the only one launched when the selector mechanism is in the first position.

When the selector mechanism is moved to the second position (FIG. 7) and the trigger mechanism is actuated by movement of button or buttons disposed on the sides of the projectile launcher inwardly, the trigger mechanism will cause at least two projectiles to be simultaneously launched from the projectile launcher. In one embodiment, the projectile launcher will launch three projectiles simultaneously from the projectile launcher when the trigger mechanism is actuated and the selector mechanism is in the second position. Of course, other numbers of projectiles may be launched when selector mechanism is in the second position and the trigger mechanism is actuated.

As illustrated in FIGS. 7 and 8 and in one embodiment, the trigger mechanism includes a pair of push buttons 30 each being disposed on a side of the projectile launcher. Each push button is biased outwardly from the projectile launcher by a spring 32. Each push button further comprises a rack portion 34 configured to engage and rotate a gear 36 of a gear train 38, which in turn rotates a shaft 40 in the direction of arrow 42. Shaft 40 has a plurality of protrusions 44 and rotation of the shaft in the direction of arrow 42 will cause at least one of the plurality of protrusions 44 to engage one of a plurality of members 46, 53 and 55 of the trigger mechanism when the push buttons are depressed inwardly towards the projectile launcher. Each of the plurality of members 46, 53 and 55 of the trigger mechanism are configured for upward and downward movement with respect to a housing of the projectile launcher in order to engage and release projectiles inserted into the projectile launcher. In one embodiment, the plurality of members 46, 53 and 55 are spring biased into a first or upward position with respect to the housing such that projectiles may be releasbly retained by features coupled to the plurality of members 46, 53 and 55. In other words, insertion of a projectile into the projectile housing will ultimately cause a hook portion of the projectile to push down the feature of one of the plurality of members 46, 53 and 55 against the biasing force until the hook portion is engaged by the feature (e.g., springs back up due to biasing force) and then the hook portion of the projectile is released as the feature is pushed downwardly against the biasing force by the trigger mechanism. Thus, projectiles can be inserted into the projectile launcher so that a launching spring of the projectile launcher is compressed and held in a compressed state until the projectile is released and subsequently launched from the projectile launcher.

In one embodiment, the rack portions of the pair of push buttons are disposed in parallel planes such that one rack is above the other and each are configured to engage a gear coupled to gear 36 such that gear 36 is rotated when at least one of the pair of push buttons is pushed into the projectile launcher and the associated rack rotates gear 36 and ultimately rotates shaft 40 in the direction of arrow 42. Accordingly and in this embodiment, only one of the push buttons needs to be depressed to rotate gear 36 and shaft 40 to launch projectiles from the projectile launcher.

Member 46 has a pair of portions 47 spring biased upwardly in a direction opposite to the rotational movement of arrow 42 and each portion 47 is configured to slidably receive a shaft member as will be discussed below. Of course, member 46 with a single portion 47 is also contemplated to be within the scope of the present invention. Portion or portions 47 of member 46 are coupled to or comprise a feature also spring biased upwardly to engage a hook portion on the end of a projectile as it is inserted into the central portion of the projectile launcher. When the selector mechanism is in the first position (FIG. 8) only portion or portions 47 of the member 46 will be depressed downwardly by the rotational movement of shaft 40 and an associated feature of the portion 47 no longer engages the hook portion of the projectile and a spring (not shown) that is compressed when the projectile is inserted into the projectile launcher is released thus launching the projectile from the projectile launcher. Therefore, a single projectile is launched when the selector mechanism is in the first position and the button or buttons 30 are depressed.

Figure 6:
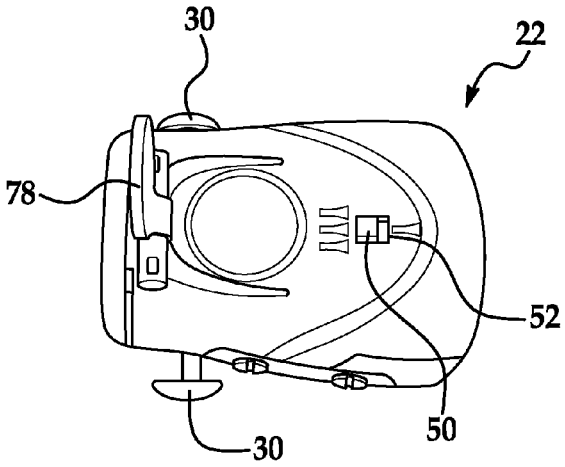
FIG. 6 is a top perspective view of the projectile launcher of a toy constructed in accordance with an exemplary embodiment of the present invention.

Referring now to FIGS. 7 and 8 and when the selector mechanism is slid in the direction of arrow 48 by manipulating a button 50 that protrudes through an opening 52 in the projectile launcher, a shaft portion 54 is received within portions 47 as well as portions 49 and 51 of members 53 and 55, which are disposed on either side of member 46. Thus, portions 47 of member 46 are now coupled to portions 49 and 51 of members 53 and 55. As illustrated, shaft portion 54 is coupled to button 50 such that movement of the same will cause movement of the shaft portion. Also shown in at least FIG. 6 is that the upper surface of the projectile launcher has features depicting the number of projectiles that will be launched when button 30 is depressed.

Members 53 and 55 and their associated portions 49 and 51 are similar to member 46 in that they are spring biased upwardly to engage a feature or hook of projectiles inserted into the projectile launcher and downward movement of the members 53 and 55 will cause the projectiles to be launched from the projectile launcher as the biasing force of compressed springs will be released and the projectiles will be launched from the projectile launcher. The interconnection of member 46 and members 53 and 55 via shaft 54 allows all three projectiles to be launched by a single depression of button 30. This is achieved by sliding shaft 54 into engagement of each of the members 46, 53 and 55 such that as member 46 is depressed by one of the plurality of protrusions each of the members are depressed downwardly and all three projectiles are launched. Alternatively and if member 53 or 55 is depressed by another protrusion 44 and shaft portion 54 is engaged by portions 47, 49 and 51 (e.g., selector mechanism in the second position) movement of anyone of the portions will cause a complimentary movement of the other portions such that all projectiles of launcher 22 are launched simultaneously. In one non-limiting embodiment, the protrusions 44 of shaft 40 are off set from each other such that one of them is configured to engage a surface 47' of portion 47 and another one of them is configured to engage a surface 51' of portion 51. Of course, other configurations are contemplated.

Of course, exemplary embodiments of the present invention contemplate more or less than three projectiles being launched when the selector mechanism is in the second position. Accordingly, movement of the selector mechanism allows a user to choose from a single shot device to a multiple shot device and vice versa.

Accordingly and when the selector mechanism is in the second position actuation or depression of the trigger mechanism will cause three projectiles to be released from the projectile launcher. Therefore, a user of the toy can easily select from one of two projectile launching options in order to provide for enhanced play.

In order to stow the projectile launcher within the housing the housing has a pair of deployable doors 56 each being pivotally secured to the housing for movement between a closed position (FIG. 1) and an open position (FIGS. 2-6).

In addition and in order to provide further extended play, each of the pair of deployable doors 56 has a launcher mechanism 58 for launching a projectile 28. In one embodiment, projectile 28 is of a standard configuration that can be launched from launcher 58 or projectile launcher 22.

As illustrated in FIGS. 2-5B, the projectile launcher is mounted to the housing by a pair of arms 60 each being pivotally and slidably mounted to the housing at one end while being pivotally mounted to the projectile launcher at the other end. At least one of the pair of arms is spring biased into the second position by a spring 62.

In order to maintain the projectile launcher in the second position a latch 64 secures one of the pair of arms to the housing to maintain the projectile launcher in the deployed position. In one embodiment, latch 64 is spring biased downwardly to engage an edge portion of one of the pair of arm members. To transition the projectile launcher from the second position to the first position or stowed position, the reward handle, which is secured to a frame 59 slidably mounted to the housing is pulled from the housing from an un-extracted position to an extracted position such that frame 59 is slid in the direction of arrow 61 and the pair of arms 60 are pivoted downwardly and the projectile launcher is stowed in the housing. Frame 59 further comprises a pair of members 63 each being connected to the rearward handle at one end and a wall portion 65 of the frame at the other end.

As frame 59 is pulled in the direction of arrow 61 wall portion 65 pushes up latch 62 and arm member 60 is no longer secured to the housing. In addition, wall portion 65 also pivots or pushes the arm member 60 that was previously secured to the housing downward such that the projectile launcher may assume the stowed position. Furthermore and as the arm members are pivoted downwardly, a tab or feature 67 of one of the pair of arm members depresses a spring biased catch 69 downwardly such that a base 70 can now slide in the direction of arrow 61. In one embodiment, base 70 is spring biased in a direction opposite to arrow 61. As illustrated, base 70 is slidably received within members 63 and the pair of arms 60 are pivotally secured to the base thus allowing for pivotal and slidable securement of the pair of arms 60 to the housing.

As the projectile launcher 22 moves in the direction of arrow 61 and into a cavity 71 of the housing a latch (not shown) engages a catch 73 of the projectile launcher. This will retain the projectile launcher in the cavity until an actuation button 74 is depressed. Once in the stowed position, the pair of deployable doors are pivoted into the closed position and the projectile launcher is retained within the housing (FIG. 1). Depression of button 74 disengages catch 73 and allows the projectile launcher and arms 60 to slide forward and extend upwardly due to the biasing forces acting upon the projectile launcher. At the same time the pair of deployable doors, if closed, will pivot open due to the movement of the projectile launcher from the stowed position to the deployed position.

In order to deploy the projectile launcher, actuation button 74 is depressed and the latch engaging catch 73 releases the same and releases the spring biasing force against the base as well as spring 62 such that the projectile launcher moves from the first position to the second position and the pair of deployable doors are pivoted open.

Figure 5A:
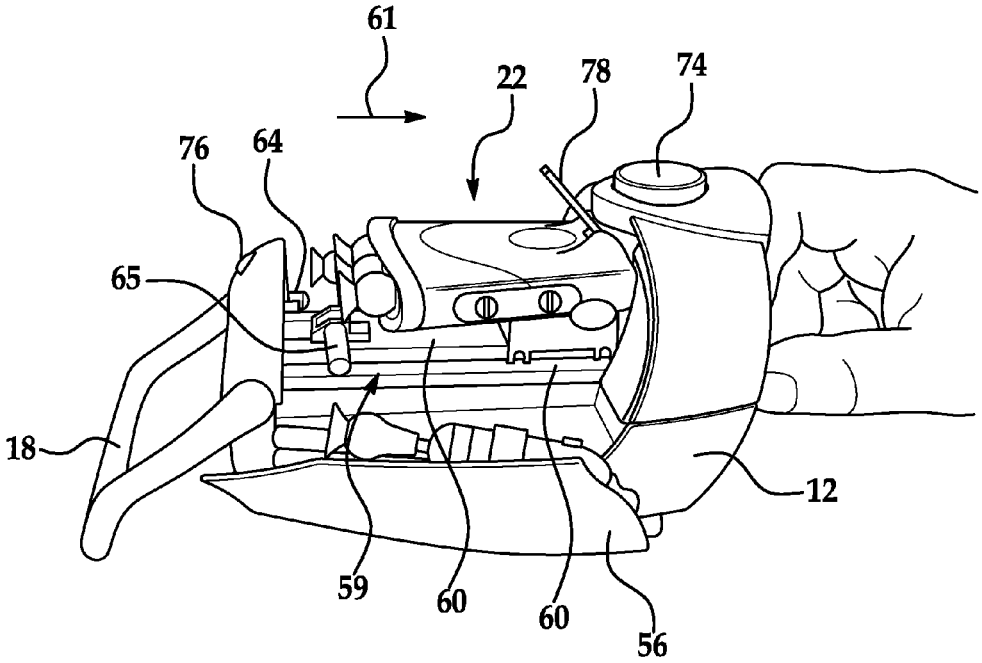
FIGS. 5A-5B are perspective views illustrating the toy transitioning from the deployed position in FIG. 2 to that of a stowed position.
Figure 5B:
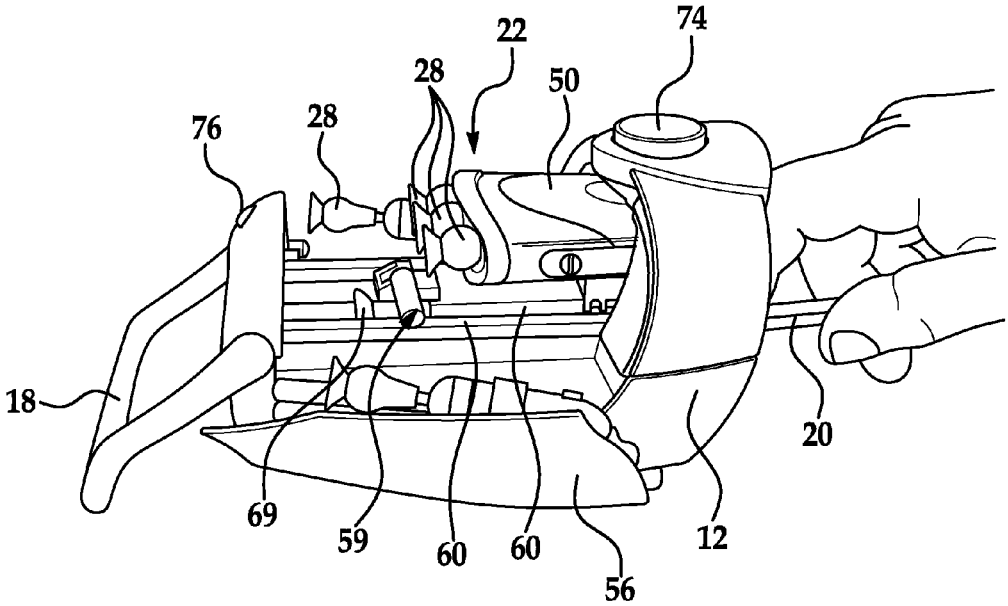

In addition, other features include a LED lamp or another equivalent device 76 that is illuminated when button 74 is depressed to provide addition effects to the toy. Still further, the toy may have sound effects that are played when button 74 is depressed. Also, a deployable sighting device 78 is pivotally mounted to the projectile launcher for movement between a deployed position (FIGS. 2-5) and a stowed position (FIGS. 5A-5B). In one implementation, the sighting device 78 spring biased into the deployed position and the movement of the projectile launcher from the deployed positioned to the stowed position causes the sighting device to be contacted by the housing and moved into the stowed position.

Accordingly, a hand held toy is provided wherein a user can deploy and subsequently stow a selectable projectile launcher that can launch one or a plurality of projectiles through manipulation of a single button. Still further and in one embodiment, the hand held toy also has a pair of deployable door members each having a projectile launcher for independently launching other projectiles.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the present application.

What is claimed is:

1. A toy, comprising:

a housing;

a projectile launcher capable of moving between a first stowed position within the housing and a second deployed position extending from the housing;

a trigger mechanism for launching at least one projectile from the projectile launcher; and a selector mechanism configured for movement between a first position and a second position, wherein the trigger mechanism will launch only a single projectile from the projectile launcher when the selector mechanism is in the first position and the trigger mechanism is actuated and wherein the trigger mechanism will launch at least two projectiles from the projectile launcher when the selector mechanism is in the second position and the trigger mechanism is actuated, wherein the housing further comprises a pair of deployable doors each being pivotally secured to the housing for movement between a closed position and an open position.

2. The toy as in claim 1, wherein the trigger mechanism will launch three projectiles from the projectile launcher when the selector mechanism is in the second position and the trigger mechanism is actuated.

3. The toy as in claim 1, wherein the projectile launcher is enclosed within the housing and the pair of deployable doors when the projectile launcher is in the first stowed position and the pair of deployable doors are in the closed position.

4. The toy as in claim 3, wherein each of the pair of deployable doors includes a launcher mechanism capable of launching a projectile.

5. The toy as in claim 4, wherein the projectile can be launched by either the launcher mechanism of each of the pair of deployable doors or the projectile launcher.

6. The toy as in claim 1, wherein the projectile launcher is spring biased towards the second position and the toy further comprises a latch mechanism for latching the projectile launcher in the first position and the toy further comprises a button for releasing the latch mechanism and allowing the projectile launcher to move from the first position to the second position wherein each of the pair of deployable doors are moved from the closed position to the open position.

7. The toy as in claim 1, wherein the selector mechanism further comprises a shaft member configured to couple at least two members of the trigger mechanism together when the selector mechanism is in the second position such that actuation of the trigger mechanism will launch at least two projectiles from the projectile launcher.

8. The toy as in claim 1, wherein the projectile launcher is movably secured to the housing by a pair of arms each being pivotally secured to the projectile launcher at one end and pivotally secured to a moveable base at the other end, the movable base being slidably received within the housing.

9. The toy as in claim 1, wherein the projectile is dart with a suction cup at a forward end and wherein the selector mechanism further comprises a shaft member configured to couple a first member of the trigger mechanism together with a second and third member of the trigger mechanism and wherein the first, second and third member are each configured to retain and release a dart.

10. The toy as in claim 9, wherein the trigger mechanism further comprises a pair of push buttons each being disposed on a side of the projectile launcher, each push button being biased outwardly from the projectile launcher by a spring and each push button is configured to engage and rotate a gear of a gear train coupled to a shaft having a plurality of protrusions wherein movement of one of the pair of push buttons inwardly towards the projectile launcher causes the shaft to rotate such that one of the plurality of protrusions contacts at least one of the first member, the second member and the third member of the trigger mechanism.

11. A hand held toy for launching projectiles, the toy comprising:

a housing having a forward end and a rearward end;

a projectile launcher capable of moving between a first stowed position within the housing and a second deployed position extending from the housing;

a trigger mechanism for launching at least one projectile from the projectile launcher;

a selector mechanism configured for movement between a first position and a second position, wherein the trigger mechanism will launch only a single projectile from the projectile launcher when the selector mechanism is in the first position and the trigger mechanism is actuated and wherein the trigger mechanism will launch at least two projectiles from the projectile launcher when the selector mechanism is in the second position and the trigger mechanism is actuated;

an actuation button for moving the projectile launcher from the first stowed position to the second deployed position; and a reward handle slidably mounted to the rearward end of the housing for movement between an extracted position and an un-extracted position, wherein movement of the reward handle from the un-extracted position to the extracted position when the projectile launcher is in the second deployed position will cause the projectile launcher to be moved into the first stowed position.

12. The hand held toy as in claim 11, wherein the trigger mechanism will launch three projectiles from the projectile launcher when the selector mechanism is in the second position and the trigger mechanism is actuated.

13. The hand held toy as in claim 11, wherein the housing further comprises a pair of deployable doors each being pivotally secured to the housing for movement between a closed position and an open position when the projectile launcher is moved from the first stowed position to the second deployed position.

14. The hand held toy as in claim 13, wherein each of the pair of deployable doors includes a launcher mechanism capable of launching a projectile.

15. The hand held toy as in claim 14, wherein the projectile can be launched by either the launcher mechanism of each of the pair of deployable doors or the projectile launcher.

16. The hand held toy as in claim 11, wherein the projectile launcher is spring biased towards the second position and the toy further comprises a latch mechanism for latching the projectile launcher in the first position.

17. The hand held toy as in claim 11, wherein the trigger mechanism further comprises a shaft member configured to couple a first member of the trigger mechanism together with a second and third member of the trigger mechanism and wherein the first, second and third member are each configured to retain and release a dart and the trigger mechanism further comprises a pair of push buttons each being disposed on a side of the projectile launcher, each push button being biased outwardly from the projectile launcher by a spring and each push button is configured to engage and rotate a gear of a gear train coupled to a shaft having a plurality of protrusions wherein movement of one of the pair of push buttons inwardly towards the projectile launcher causes the shaft to rotate such that one of the plurality of protrusions contacts at least one of the first member, the second member and the third member of the trigger mechanism.

18. The hand held toy as in claim 11, wherein the projectile launcher is movably secured to the housing by a pair of arms each being pivotally secured to the projectile launcher at one end and pivotally secured to a moveable base at the other end, the movable base being slidably received within the housing.

19. A method of selecting launching configurations of a toy projectile launcher, comprising:

sliding a selector mechanism of the toy projectile launcher between a first position and a second position, wherein the selector mechanism couples at least two members of a trigger mechanism together when the selector mechanism is in the second position such that movement of the one of the members will cause movement of the other one of the members and actuation of a button of the trigger mechanism will move one of the at least two members; and wherein the selector mechanism isolates the at least two members from each other when the selector mechanism is in the first position such that movement of the button of the trigger mechanism will only move one of the at least two members.

* * * * *